United States Patent [19]

Saitoh

[11] 4,171,592

[45] Oct. 23, 1979

[54] TOY MOVING CAR OPERATED BY A WIRELESS ELECTRIC DEVICE

[76] Inventor: Shigeru Saitoh, No. 6-4, 2-chome, Kuramae, Taito-ku Tokyo, Japan

[21] Appl. No.: 816,872

[22] Filed: Jul. 18, 1977

[51] Int. Cl.[2] ..... A63H 30/04

[52] U.S. Cl. ..... 46/235; 46/254; 46/262

[58] Field of Search ..... 46/253, 254, 234, 235

[56] References Cited

U.S. PATENT DOCUMENTS

| | | | |
|---|---|---|---|
| 1,951,505 | 3/1934 | Dambrine | 46/253 |
| 3,961,441 | 6/1976 | Sato | 46/262 X |
| 4,034,504 | 7/1977 | Sudo | 46/254 |

FOREIGN PATENT DOCUMENTS

| | | | |
|---|---|---|---|
| 2223033 | 11/1973 | Fed. Rep. of Germany | 46/254 |
| 2605578 | 11/1976 | Fed. Rep. of Germany | 46/235 |

*Primary Examiner*—F. Barry Shay
*Attorney, Agent, or Firm*—Michael J. Striker

[57] ABSTRACT

A toy moving car is a toy car operated by a wireless electric device and comprises a car and a wireless electric transmitter in separation. All means including a driving means and a braking means are mounted on a bottom plate of the car. A pair of front wheels of the driving means are mounted on a front axle which is journaled in both sides of an axle support frame. The axle support frame is pivoted on the bottom plate. The braking means comprises a receiver, an electromagnet and a pair of brake disks. A sliding frame is adapted to slide laterally on the axle support frame and is equipped with the electromagnet having a pair of magnet cores. Each of the brake disks is fixed to each inside surface of the front wheels by a leaf-spring as a buffer. During a time that the receiver is receiving the electric wave from the transmitter, the electromagnet works and either one of the magnet cores which is closer to one of the brake disks sticks to said one brake disk. Therefore, the front wheel is braked and the car runs while turning to the braked side and changing alternately a turning direction by each transmission of the electric wave.

1 Claim, 11 Drawing Figures

TOY MOVING CAR OPERATED BY A WIRELESS ELECTRIC DEVICE

The present invention relates to a toy moving car of which a running direction may be changed by operating a wireless electric device.

Heretofore, toy moving cars have been known of which a running direction was changed by operating a wired electric device. Since these toys ran while drawing a long wire, they appeared awkward.

It is, therefore, an object of the present invention to provide a smart moving car.

Another object is the provision of the toy moving car which has long-lasting appeal for children.

According to the present invention, there is provided a toy moving car which comprises a car and a wireless transmitter in separation. Said car comprises a car body, a bottom plate, two pairs of front and rear wheels, a driving means and a braking means including a wireless receiver. The wireless transmitter is fitted with a key and an antena, and it can be held and handled by hand. The bottom plate is provided with all means operating the toy car. Among the driving means, a front axle and a pair of front wheels are mounted on an axle support frame which is pivoted at a screw on the center line on the front portion of the bottom plate and is adapted to turn between a definite angle limited by a pair of stoppers fixed to both sides of the bottom plate in front of said support frame. The front axle is journaled at both sides of said support frame and a pair of front wheels are rotarily mounted on both ends of said front axle, respectively. Each of the front wheels is fitted with a brake disk and a leaf-spring as a buffer on an inside surface of it. A guide channel is perforated transversely on said support frame. A sliding frame is mounted on the axle support frame so as to slide along the guide channel. The sliding frame is equipped with an electromagnet which has two U-shaped magnet cores. Said magnet cores are made to project outwardly from both sides of the sliding frame. Electricity flows in the electromagnet by the receiver while said receiver is receiving the electric wave from a transmitter and the electromagnet works for braking a front wheel. A connecting projection of the sliding frame is projecting rearward at the middle of the back of the sliding frame. A support stands on the center line of the bottom plate in rear of the axle frame. A connecting disk is pivoted on the upper end of said support by a screw and a coiled spring and has a depression of which the opening is narrow and the interior is wide. The connecting projection is adapted to be inserted in the depression of the connecting disk. The axle support frame is always forced to restore the normal position by a spring. If the electric wave is sent to the receiver of the car from the transmitter, the electromagnet works and one of the U-shaped magnet cores of which the ends are closer to the brake disk of the one front wheel attracts said brake disk and sticks to said brake disk by sliding the sliding frame. Therefore, said front wheel is braked and the car turns to the braked side while running and simultaneously the support frame turns to the same side with the car. Accordingly turning of the support frame is accompanied by turning of the connecting projection which turns the connecting disk in the reverse direction. Therefore, the opening of the depression is removed beyond the center line of the bottom plate. When the electric wave is stopped, the electromagnet stops its action and the braked front wheel is released from braking. Therefore, the support frame is made to return the normal position by the spring and the car runs straightly. But, since the connecting disk is not turned by pressing force of the screw and the coiled spring, and the opening of the depression remain in that position, the released sliding frame is made to slide in a position that the other magnet core becomes closer to the brake disk in the opposite side. If the electric wave is sent from the transmitter again, the electromagnet works again and the sliding frame sticks to the other front wheel and brakes it. Therefore, the car turns to the opposite side while running. Accordingly, the projection of the sliding frame turns the connecting disk to a direction opposite to turning of the braked front wheel and the opening of the depression of the connecting disk is returned beyond the center line to the first position. Then if the electric wave is stopped, the support frame returns to the normal position by the spring and the sliding frame becomes closer to the brake disk of the one front wheel. Namely, the support frame returns to the first condition. Therefore, the car runs while changing alternately its running direction by each transmission of the electric wave. The car continues turning to one side in running during a time of transmission.

As described above, players can operate the toy car at will by pushing the key of the transmitter. Therefore, the present invention provides a new and amusing toy which may attract children's interest.

The present invention will be better understood and other objects and advantages of the present invention will become apparent upon perusal of the following description taken in connection with drawings, in which.

Figure 1:
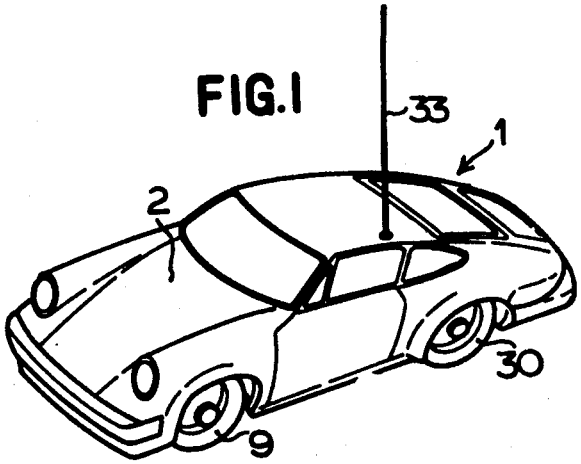
FIG. 1 is a front perspective view of a moving car of the present invention.
Figure 2:
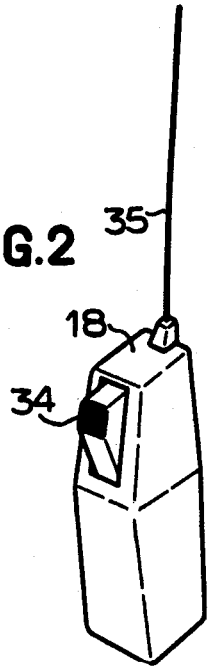
FIG. 2 is a side perspective view of a transmitter thereof.
Figure 4:
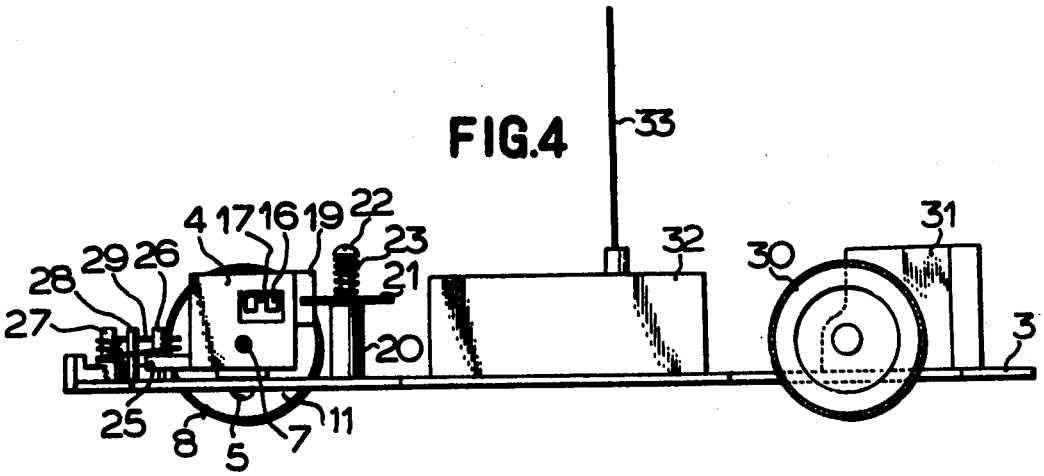
FIG. 4 is a side elevational view of FIG. 3 cut off along line IV—IV thereof.

Referring more particularly to the drawings, the preferred embodiment of the present invention will now be described as follows. The mechanism of the present invention may be explained referring to FIGS. 1 to 11.

A car 1 is formed with a body 2 and a bottom plate 3 in appearance. The bottom plate 3 is provided with all means operating the car 1. An axle support frame 4 is pivoted at a screw 5 standing on the center line in the front portion of the bottom plate 3 and is made to turn easily between a definite angle limited by both ends of a stopper 6. A front axle 7 is journaled at both ends of the axle support frame 4 and a pair of front wheels 8 and 9 are idly mounted respectively on both ends of said front axle 7. Each of the front wheels 8 and 9 is fitted with a brake disk 11 and a leaf-spring 10 as a buffer on an inside surface of it. A guide channel 12 is perforated transversely on said axle support frame 4. A sliding frame 13 is mounted on the axle support frame 4 so as to slide along the guide channel 12 by inserting both legs 14 of said sliding frame 13 into said guide channel 12. The sliding frame 13 is equipped with an electromagnet 15 which has two U-shaped magnet cores 16. The magnet cores 16 are made to project outwardly from both ends of the sliding frame 13 and to pass through both guide holes 17 of the axle support frame 4. The sliding frame 13 has a rearward projecting connecting projection 19 at the middle of the back side of it. A support 20 stands on the center line of the bottom plate 3 in rear of the axle support frame 4. A connecting disk 21 is pivoted on the upper end of said support 20 by a screw 22 and a coiled spring 23. Said connecting disk 21 has a fish tail-fin shaped depression 24 in which said connecting projection 19 is inserted. The axle support frame 4 has an arm 25 projecting from the middle of the front side of it. A pin 26 stands on the end of said arm 25. A spring support 27 and a stopper pin 28 stand respectively in front and rear on the front portion and the center line of the bottom plate 3. The spring support 27 is fitted with a bi-forked spring 29 of which the two branches are separated by a stopper pin 28 and are adapted to pinch the pin 26 of the arm 25. A pair of rear wheels 30 are driven by an electromotor 31. A container 32 houses a source of electricity (not shown) and a receiver (not Shown) of which an antena 33 projects from upward from the body 2. The transmitter 18 has a key 34 and an antena 35.

Figure 3:
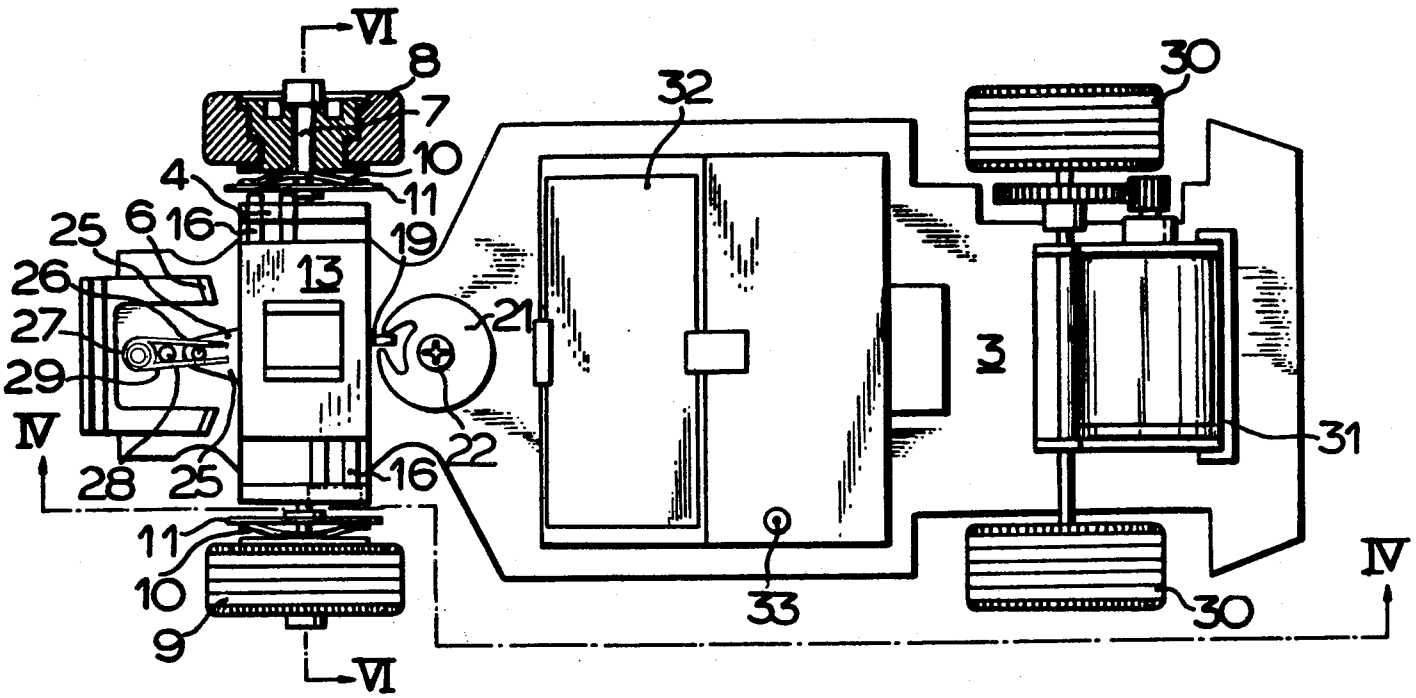
FIG. 3 is a plan view of the moving car taken off a car body and cut off partly at a normal position thereof.
Figure 5:
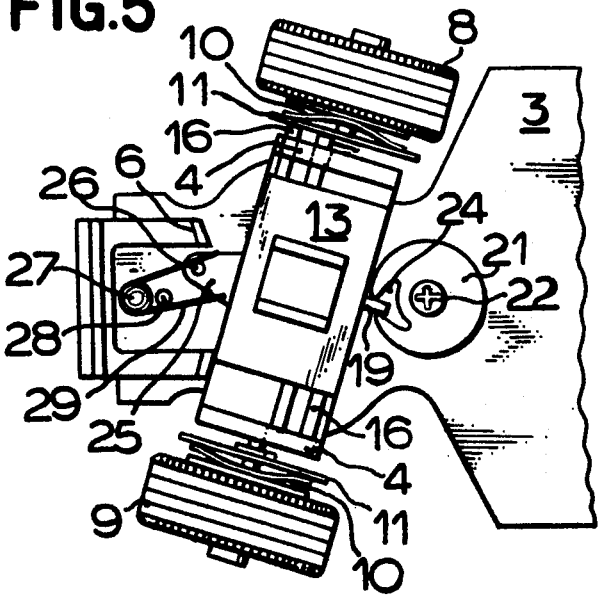
FIG. 5 is a plan view of the front portion of a bottom plate and an axle support frame turning to one side from the normal position in FIG. 3 thereof.
Figure 6:
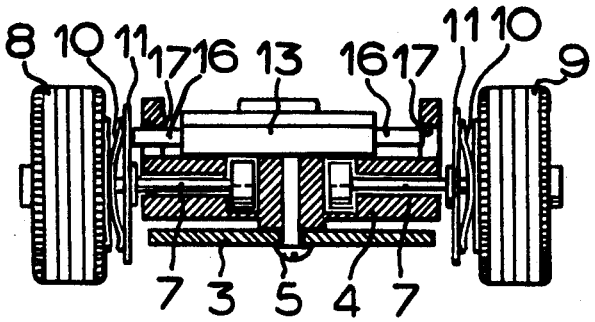
FIG. 6 is a front elevational view of FIG. 3 cut off along line VI—VI thereof.
Figure 7:
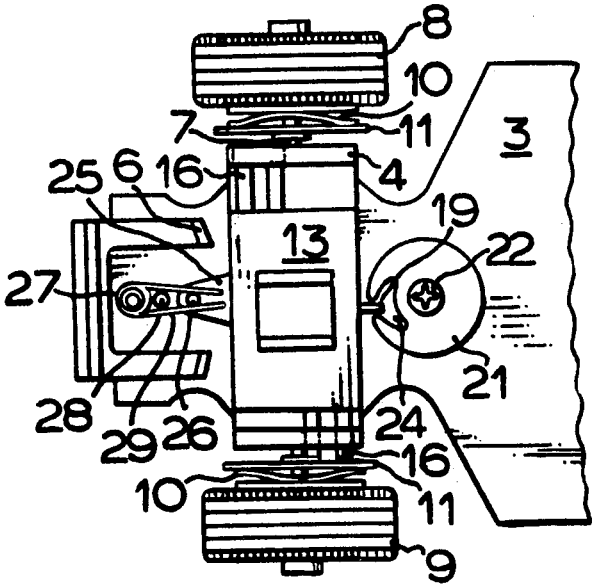
FIG.7 is a plan view of the front portion of the bottom plate and the axle support frame returning to the normal position from the position of FIG. 5 thereof.
Figure 8:
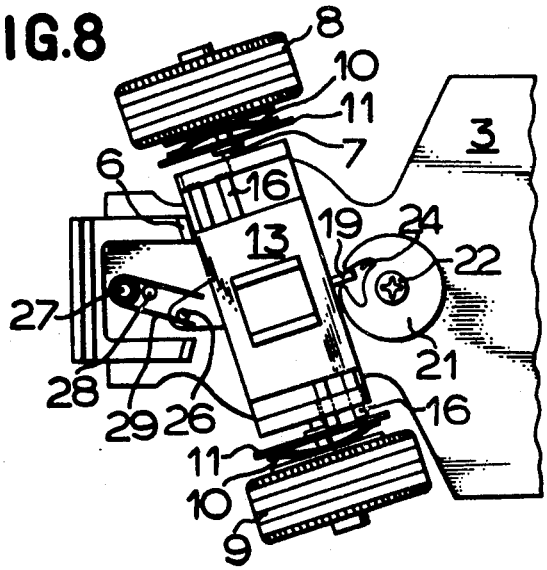
FIG. 8 is a plan view of the front portion of the bottom plate and the axle support frame turning to the other side thereof.
Figure 9:
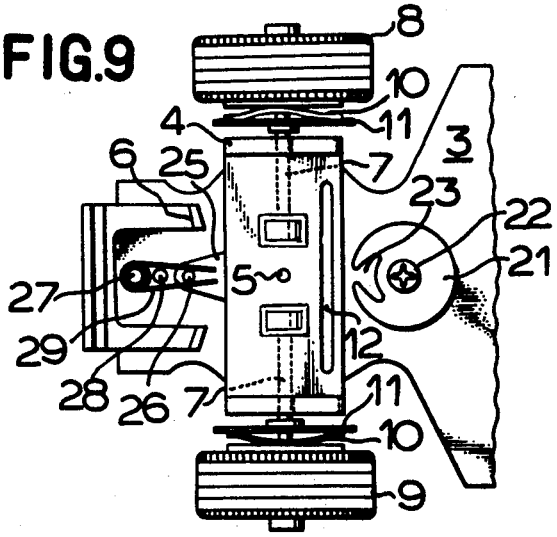
FIG. 9 is a plan view of the front portion of the bottom plate and the axle support frame taken off a sliding frame thereof.
Figure 10:
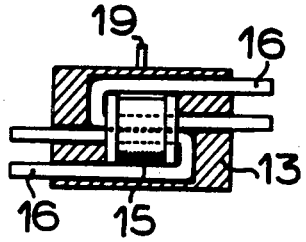
FIG. 10 is a plan view of the sliding frame thereof.
Figure 11:
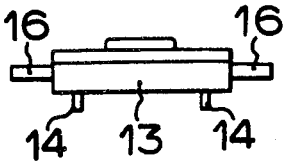
FIG. 11 is a front side elevational view of the sliding frame thereof.

As the present invention has been described above, when a switch (not shown) in the car 1 is closed, the electromotor 31 works and the car 1 moves by the driven rear wheels 30 on a plain floor. In case that the receiver (not shown) of the moving car 1 receives the electric wave sent from the transmitter 18 by pushing the key 34, electrically flows in the electromagnet 15. Therefore, the electromagnet 15 works and each of the two magnet cores 16 displays magnetic force of each of the brake disks 11, respectively. But one of the two magnet cores 16, which is closer to one of the two brake disks 11 as shown in FIG. 3, may attract and stick to said one of the brake disks 11 as shown in FIG. 5 and simultaneously the sliding frame 13 is removed to the side of said one of the brake disk 11 as shown in FIG. 5. Namely, the front wheel 8 is braked and the car 1 turns righthandedly while running. The biforked spring 29 acts as a force to restore the axle support frame 4 to the normal position for running the car 1 straightly, but a turning force of the axle support frame 4 overcomes repulsion of said biforked spring 29. When the sliding frame 13 turns rightward together with the axle support frame 4 as shown in FIG. 5, the connecting projection 19 turns righthandedly and the connecting disk 21 is made to turn lefthandedly on the contrary since a turning force of said connecting projection 19 overcomes a pressing force of the coiled spring 23 and the screw 22 against said connecting disk 21. When the key 34 of the transmitter 18 is released from pushing, transmission of the electric wave stops and the receiver stops to actuate the electromagnet 15. Then the sticking magnet core 16 separates from the brake disk 11 and the front wheel 8 is liberated from braking. The axle support frame 4 is restored to the normal position by repulsion of the biforked spring 29 through the arm 25 as shown in FIG. 7 and the car 1 may run straightly on the floor without turning. Simultaneously, the sliding frame 13 is made to slide along the guide channel 12 to the side of the front wheel 9 by engagement of the connecting projection 19 and the tailfin-shaped depression 24 of the connecting disk 21 which does not turn righthandedly by pressing of the coiled spring 23 and the screw 22 as shown in FIG. 7. Namely, FIG. 7 forms a contrast with FIG. 3 and the sliding frame 13 is closer to the brake disk 11 of the front wheel 9. Then when the receiver receives the electric wave again, the electromagnet 15 works again and the sliding frame 13 sticks to the front wheel 9 by attraction of the magnet core 16 and the brake disk 11, and said sliding frame 13 brakes said front wheel 9 and the car 1 turns to the side of the braked front wheel 9 during a time of transmission while running as shown in FIG. 8. If the electric wave is stopped again, the front wheel 9 is liberated from braking and the axle support frame 4 returns to the normal position as the same as shown in FIG. 3. As described above, the car 1 may run while turning alternately by each transmission of the electric wave.

Thus the present invention provides a new and amusing toy which may attract children's interest.

While a particular embodiment of the present invention has been illustrated and described, it is obvious that many modifications and variations of the present invention are possible in the light of the above teachings. It is, therefore, to be understood that within the scope of the appended claims the invention may be practiced otherwise as specifically described.

What is claimed as new and desired to be secured by Letters Patent of the United States is:

1. A toy moving car which is operated by a wireless electric device, comprising a car and a wireless transmitter in separation, said car being formed with a body and a bottom plate, said bottom plate being provided with all means operating the car including a braking means, said braking means comprising a pair of brake disks, a sliding frame having an electromagnet, and a receiver, an axle support frame being symmetrically pivoted on the front portion and the center line of said bottom plate and being adapted to turn between a definite angle limited by ends of a stopper fixed to both sides of said bottom plate in front of said support frame, a front axle being journaled at both sides of said support frame and a pair of front wheels being rotatably mounted respectively on both ends of said front axle, each of the front wheels being fitted with one of the brake disks and a buffer of a leaf-spring on an inside surface of said front wheel, a guide channel being perforated transversely on the support frame, the sliding frame being mounted on the support frame so as to slide along said guide channel, said sliding frame being equipped with said electromagnet which has a pair of U-shaped magnet cores, said magnet cores projecting outwardly from both sides of the sliding frame, a connecting projection of the sliding frame projecting rearward at the middle of the back of the sliding frame, a support on the center line of the bottom plate in the rear of the axle support frame, a connecting disk pivoted on the upper end of said support by a screw and a coiled spring and having a depression with a narrow opening and a wide interior, the connecting projection being adapted to be inserted to the depression of the connecting disk, the axle support frame being adapted to be forced to return to the normal position by a spring, and the electromagnet being adapted to be actuated by the receiver during transmission of electromagnetic waves so that the car runs while turning alternatively upon each transmission of the electromagnetic waves.

* * * * *